United States Patent [19]

Seong

[11] Patent Number: 4,812,068

[45] Date of Patent: Mar. 14, 1989

[54] WRITING DEVICE WITH ALARM

[76] Inventor: Jae Pil Seong, 733-1271, Dongcheon-dong, Kyeongju-shi, Kyeongsangbuk-do, Rep. of Korea

[21] Appl. No.: 219,674

[22] Filed: Jul. 15, 1988

[51] Int. Cl.[4] ..... B43K 29/00

[52] U.S. Cl. ..... 401/195; 362/118

[58] Field of Search ..... 401/195; 362/118

[56] References Cited

U.S. PATENT DOCUMENTS

| | | | |
|---|---|---|---|
| 2,184,585 | 12/1939 | Devine | 362/118 |
| 3,502,859 | 3/1970 | Kochan | 362/118 M |
| 3,963,914 | 6/1976 | Browing et al. | 362/118 |

FOREIGN PATENT DOCUMENTS

| | | | |
|---|---|---|---|
| 47379 | 3/1982 | European Pat. Off. | 401/195 |
| 695801 | 9/1940 | Fed. Rep. of Germany | 362/118 |
| 3421905 | 12/1985 | Fed. Rep. of Germany | 401/195 |
| 1001206 | 8/1965 | United Kingdom | 362/118 |
| 2127754 | 4/1984 | United Kingdom | 401/195 |

*Primary Examiner*—Steven A. Bratlie

*Attorney, Agent, or Firm*—Donald C. Feix; T. M. Freiburger

[57] ABSTRACT

An alarm-generating writing device is disclosed, the constitution of which is such that a push bottom switch is provided on the body of the writing device (pen or pencil), the push button switch being able to close the circuit in order to activate an alarm. When the user of the writing device releases the push button switch due to exhaustion or falling asleep, the springing push button switch closes the inner circuit of the writing device in order to activate the alarm, whereby awakening the user from the sleeping state.

1 Claim, 3 Drawing Sheets

WRITING DEVICE WITH ALARM

FIELD OF THE INVENTION

The present invention relates to a writing device which can emit a warning sound in order to awaken a person who has fallen asleep while working or studying. Therefore the device of the present invention is useful to students who are preparing for examinations.

BACKGROUND OF THE INVENTION

Conventionally, there was a writing device in which an alarm was attached. But this alarm was not for awakening the person from a sleeping state, but for indicating the fact that an appointed time or a preset time had arrived.

Generally, serious students who are immersed in ardent and assiduous studies may have difficulty in getting the proper amount of sleep for good health. A student who does not get enough sleep may tend to relax slightly and fall asleep while studying, dropping his pen at the same time. And once such a student falls asleep, his sleep is of a deep kind. In such a situation, his studies cannot be carried out at a predetermined schedule.

SUMMARY OF THE INVENTION

The present invention is intended to give a solution to the above described prob? ems, and it is the object of the present invention to provide a writing device in which a warning sound is generated if the person using the writing device falls asleep and releases the grasping of the writing device. The object is achieved by arranging that, if the person grasps the writing device for writing, a switch lever is pushed in, thereby cutting off the power source. If the person falls asleep and thereby releases his grasp of the writing device, the switch lever is sprung out, thereby connecting the power source to the alarming device and thereby causing the alarming device to emit an alarm in the form of a melody or vocal sound. Thus, the user or the student is awakened from the sleeping state.

BRIEF DESCRIPTION OF THE DRAWINGS

The above object and other advantages of the present invention will become more apparent by describing the preferred embodiment of the present invention with reference to the attached drawings in which.

DESCRIPTION OF THE PREFERRED EMBODIMENT

Figure 1:
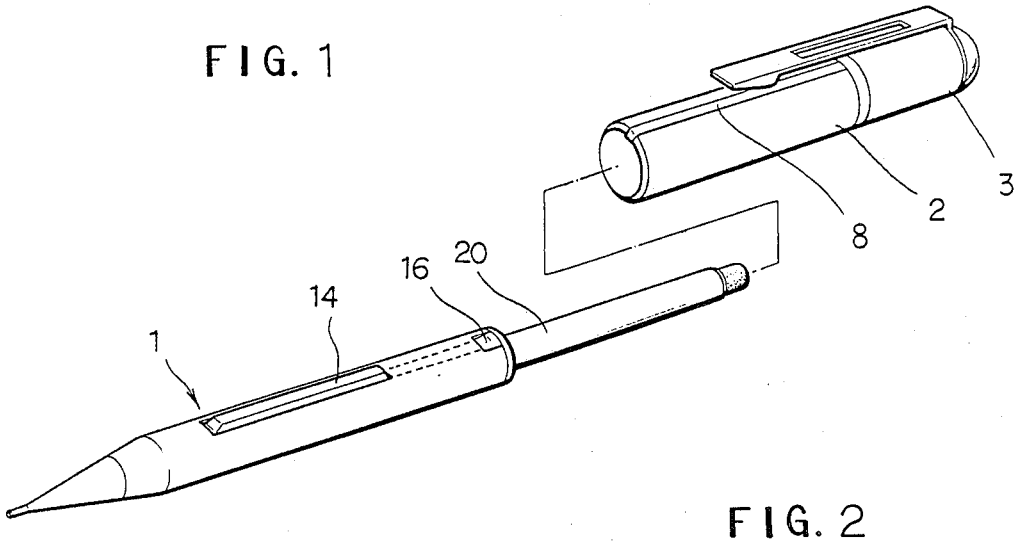
FIG. 1 is a perspective view of the writing device according to the present invention.
Figure 2:
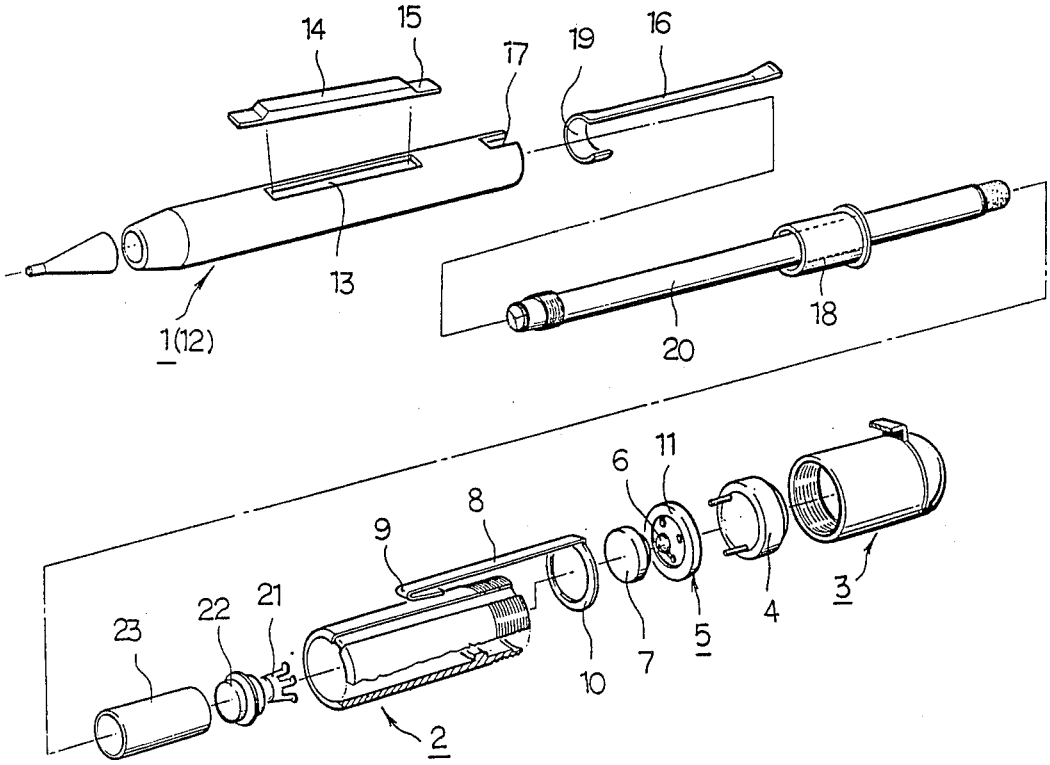
FIG. 2 is an exploded perspective view of the writing device according to the present invention.

In the device of the present invention, the main body 1 of the writing device is provided with a switching means, and the cap portion 2 is provided with an alarming device, the writing device being activated only when the main body 1 and the cap portion 2 are joined together. A cap 3 is mounted on the top of the cap portion 2 of the present invention.

Inside the cap 3, there are accommodated a buzzer 4, a chip-bonding board 5 and a mercury cell 7, the last of which is connected to the contact point 6 of the board 5. A conductive connector 8 is connected from the top of the cap portion 2 to the bottom of the same. A hook portion 9 of the conductive connector 8 is provided at the tip of the said connector 8, while a ring 10 is attached at the other tip of the connector 8. This ring 10 is contacted to a metal terminal 11 of the chip-bonding board 5 when the cap portion 2 and the cap 3 are threadably joined together.

The cap portion 2 receives sequentially a conductive spring 21, holder 22 and connecting tube 23, and retains them.

The outer case 12 of the main body 1 is provided with a elongated slot 13 in which a switch lever 14 is inserted. The switch lever 14 is provided with extended tips 15 at the opposite ends thereof, so that the said tips 15 should abut against the edges of the elongated slot 13 in order to keep the switch lever 14 from being sprung off. A switch piece 16 in the form of a flat metal spring is inserted under the switch lever 14 in order to provide an elastic force to the said lever 14.

The upper end of the switch piece 16 is engage with a connection slot 17 provided at the upper end of the outer case 12 of the min body 1, and at the same time, pressed to and retained on the outer surface of a socket 18. When the main body and the cap portion of the writing device are joined together, the switch piece 16 is contacted to the hook portion 9 of the conductive connector 8.

A C-type ring 19 attached at the lower end of the switch piece 16 is located around an elongated metal tube 20, the inner diameter of the ring 19 being larger than the outer diameter of the metal tube 20.

Figure 3:
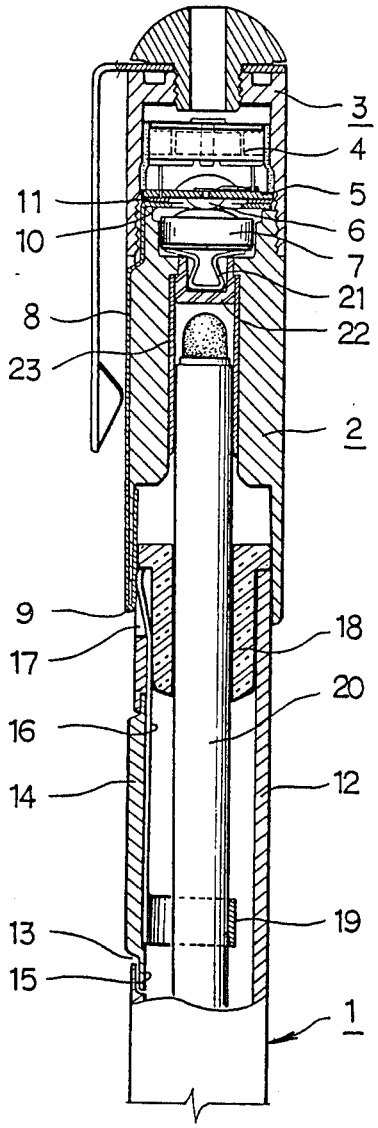
FIG. 3 is a sectional view of the writing device in which an activated state is illustrated.

The switch piece 16 has an elastic force for elastically pushing the switch lever 14, so that, so long as the switch lever 14 is not intentionally pressed, the ring 19 provided at the lower end of the switch piece 16 will be contacted onto the metal tube 20. That is, as shown in FIG. 3, the lower portion of the ring 19 is contacted onto the elongated metal tube 20.

The metal tube 20 is an ordinary type of tube of the kind which contain pencil leads, and even if this metal tube contains other things, such as ball point pen ink, sign pen ink, fountain pen ink, etc., if the metal tube is composed of conductive metal, it will give the same effect.

One portion of the electric circuit of the device according to the present invention is connected from the front face (the central contact point) of the mercury cell 7 through the central contact point of the chip-bonding board 5 to the lower terminal of the buzzer 4.

On the other hand, the other portion of the circuit is connected from the rear face of the mercury cell 7 through the spring 21, the holder 22, the connecting tube 23, the elongated metal tube 20, the switch piece 16, the conductive connector 8, and the metal terminal 11, to the upper terminal of the buzzer 4.

Thus, if the switch piece 16 is connected to the elongated metal tube 20, the power source is turned on and the buzzer 4 is activated. But if the switch piece 16 is separated from the metal tube 20, the power source is turned off and the buzzer 4 is inactivated.

Figure 4:
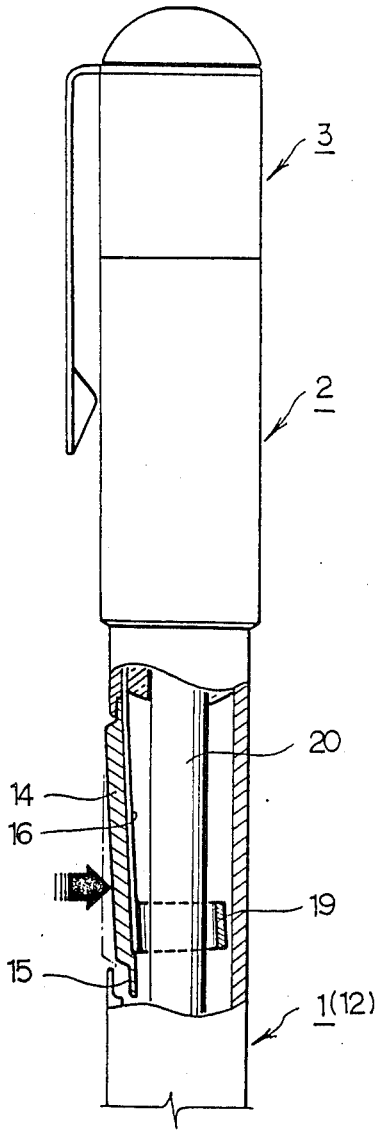
FIG. 4 is a partially sectional view of the writing device in which an inactivated state is illustrated.
Figure 5:
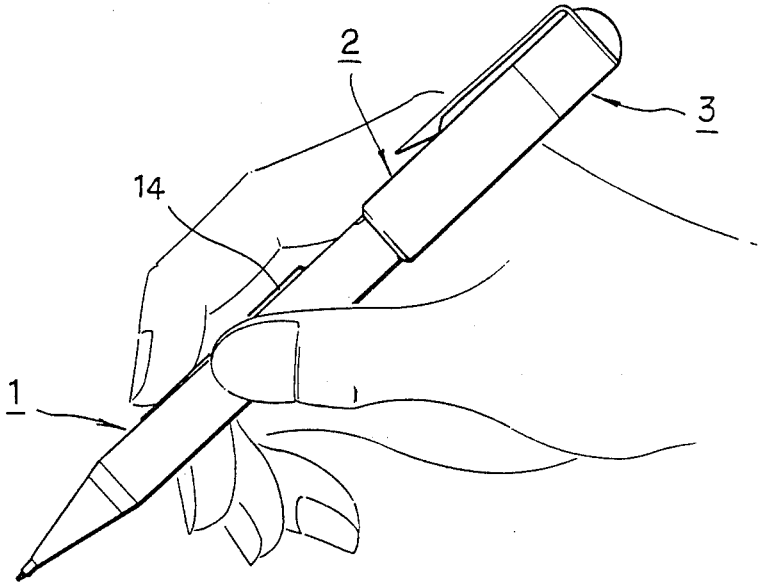
FIG. 5 illustrates the use of the writing device of the present invention.

As a user of the writing device of the present invention keeps pressing down the switch lever 14 with his fingers, the power source remains in an off-state, and therefore, the buzzer cannot be activated, as shown in FIG. 4.

However, due to reasons such as falling asleep, if the user of the writing device relaxes or releases his grasp of the switch lever 14, the circuit turns to an on-state and 10 the buzzer 4 is activated, emitting an alarm as shown in FIG. 3.

The cap 3 is provided with a hole for venting out the sound wave which is generated by the buzzer 4, and the said hole is also adapted to receive a plug for an earphone. Thus, if the person using the writing device uses earphones, only he hears the alarm buzzer and others nearby are not disturbed.

Further, instead of the buzzer mentioned above, the device of the present invention can be provided with a melody chip or a composite voice chip, and an amplifier also can be used in order to amplify the sound level.

Figure 6:
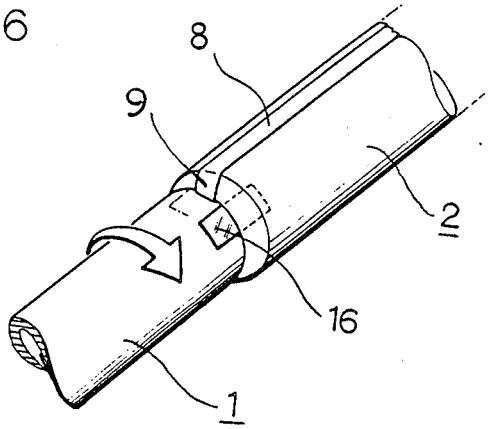
FIG. 6 shows a switched-off state of the writing device, this switched-off position being set when the alarm is not needed.

As there may be cases where there is no need for an alarm at all, an alarm position of inactivation is provided which can be utilized at the user's option. As shown in FIG. 6, this inactive position is constituted such that the cap portion is turned relative to the main body, or the cap portion is inversely ;joined to the main body, so that the pertinent contact points between the cap portion and the main body should be separated. The writing device set to such an inactivation position cannot emit an alarm, and therefore, it is just like an ordinary writing pen or pencil.

As the device of the present invention can prevent the user from undesirable sleep, it is believed that students or anyone preparing for examinations will conveniently utilize the device. Further, the principle of the present invention can be applied to various kinds of writing pen and pencils; or pens with the device of the present invention attached can be used in an inactivated state like an ordinary pen.

It should be understood that various changes and modifications can be added to the embodiment described above without departing from the scope of the present invention. The scope of the present invention will be limited only by the attached patent claim.

What is claimed is:

1. A writing device having an alarm comprising:

a cap and cap portion assembly sequentially containing in connected state a buzzer, a chip-bonding board, a mercury cell, a conductive spring, a holder, and a connecting tube; a connecting piece installed in such a manner that its total length is extended along the total length of the cap portion, its front hook being positioned at the front end of the cap portion, and its ring portion being positioned in contact with the metal terminal of the chip-bonding board; and a main body of the said device provided with a elongated slot and a connection slot and accommodating a switch piece, a switch lever an elongated metal tube and a socket, which are arranged in such a manner that the upper end of the switch piece aligned with the connection slot is secured by means of the socket, and is connected to the hook of the conductive connector, and the ring at the lower end of the switch piece is positioned around the elongated metal tube in a state elastically urged upward, this rising switch piece being restricted by the switch lever which is installed within the elongated slot.

* * * * *